US005278612A

United States Patent [19]

Inui

[11] Patent Number: 5,278,612

[45] Date of Patent: Jan. 11, 1994

[54] APPARATUS FOR JUDGING LIFE OF PHOTOCONDUCTOR

[75] Inventor: Koichi Inui, Higashi-Osaka, Japan

[73] Assignee: Sharp Kabushiki Kaisha, Osaka, Japan

[21] Appl. No.: 935,896

[22] Filed: Aug. 26, 1992

[30] Foreign Application Priority Data

Aug. 28, 1991 [JP] Japan ..... 3-217216

[51] Int. Cl.[5] ..... G03G 21/00

[52] U.S. Cl. ..... 355/206; 355/211; 355/219

[58] Field of Search ..... 355/206, 208, 211, 219

[56] References Cited

U.S. PATENT DOCUMENTS 5,012,282 4/1991 Wanou et al. ..... 355/219
5,132,738 7/1992 Nakamura et al. ..... 355/219 X
5,160,967 11/1992 Tonegawa ..... 355/208

FOREIGN PATENT DOCUMENTS 57-172362 10/1982 Japan .
63-133166 6/1988 Japan .
1-66669 3/1989 Japan .
1-154175 6/1989 Japan .
2-195366 8/1990 Japan .

*Primary Examiner*—Fred L. Braun
*Attorney, Agent, or Firm*—David G. Conlin; George W. Neuner; Peter F. Corless

[57] ABSTRACT

An image forming apparatus has a charging roller disposed in contact with a photoconductor having a photoconducting layer for charging the surface of the photoconductor, and a photoconductor life judging device including an element for detecting the change of the value of the current flowing through the charging roller and an element for judging the photoconductor life on the basis of the change of the current value.

9 Claims, 5 Drawing Sheets

APPARATUS FOR JUDGING LIFE OF PHOTOCONDUCTOR

BACKGROUND OF THE INVENTION

1. Field of the Invention

This invention relates to an image forming apparatus, for charging a surface of a photoconductor by a charging roller, which comprises a judging means for judging a life of the photoconductor.

2. Description of the Related Art

In an image forming apparatus which performs image forming process using a photoconductor having a photoconductive layer, it is known that deterioration of the photoconductor results in reduction of a image quality to be formed. For instance, when a surface potential of the photoconductor increases due to the deterioration, the charges can not be sufficiently canceled by an exposing process and fogs would arise in the formed image so as to provide deteriorated images only. Accordingly, it is necessary to replace the photoconductor depending on the degree of the deterioration in order to constantly obtain images of high stability and quality. Conventionally, the photoconductor has been used to be replaced when the numbers of the formed images reaches a predetermined number (e.g. approximately 40,000).

However, such manner of judging the time for replacing the photoconductor as mentioned above bases on the predetermined numbers of the formed images, irrespective of the actual used state of the photoconductor. Further, taking account of the dispersion of the individual life of the photoconductors. the threshold value of the numbers of the formed images in the counting-type photoconductor replacing method has been set to a significantly low value, taking account of the case where the life is shortest. As a result, it has been quite usual that still certainly usable photoconductors are replaced.

SUMMARY OF THE INVENTION

It is therefore an object of this invention to provide an image forming apparatus, having a means for judging a life of a photoconductor, which is capable of judging the life of the photoconductor when the photoconductor undesirably affect the image quality itself for avoiding such waste as replacing still usable photoconductor.

Incidentally, when a charging process is applied to the surface of the photoconductor by using a charging roller, a circuit composed of a power source for the charging roller, a charging roller, and the photoconductor is provided Therefore, if the photoconductor deteriorates to increase the surface potential, correspondingly the current value flowing through the charging roller becomes also increased. FIGS. 5 and 6 show respectively, the relationship between the degree of deterioration and the surface potential of the photoconductor, and the relationship between the degree of deterioration of the photoconductor and the value of the current flowing through the charging roller. These FIGS. reveal that the deterioration of the photoconductor increases the surface potential of the photoconductor as well as the value of the current flowing through the charging roller. This means that the deteriorated degree of the photoconductor can be represented by the value of the current flowing through the charging roller.

In this invention, therefore, the life of the photoconductor is judged by measuring the current value of the actually used charging roller. Therefore, unlike the conventional method of judging the replacing time of the photoconductor based on the numbers of the formed images, the life of each photoconductor could be accurately judged.

An image forming apparatus according to this invention comprising: a charging roller 12 disposed in contact with the photoconductor 11, having a photoconductive layer 11*b* for charging the photoconductor 11; and a photoconductor life judging means for judging the photoconductor life; wherein the judging means includes a means for detecting the change of the value of the current flowing through the charging roller; and a means for judging the photoconductor life on the basis of the change of the current value.

Further objects and advantages of the present invention will be apparent from the following description of the preferred embodiments of the invention as illustrated in the accompanying drawings.

DESCRIPTION OF THE PREFERRED EMBODIMENTS

Figure 1:
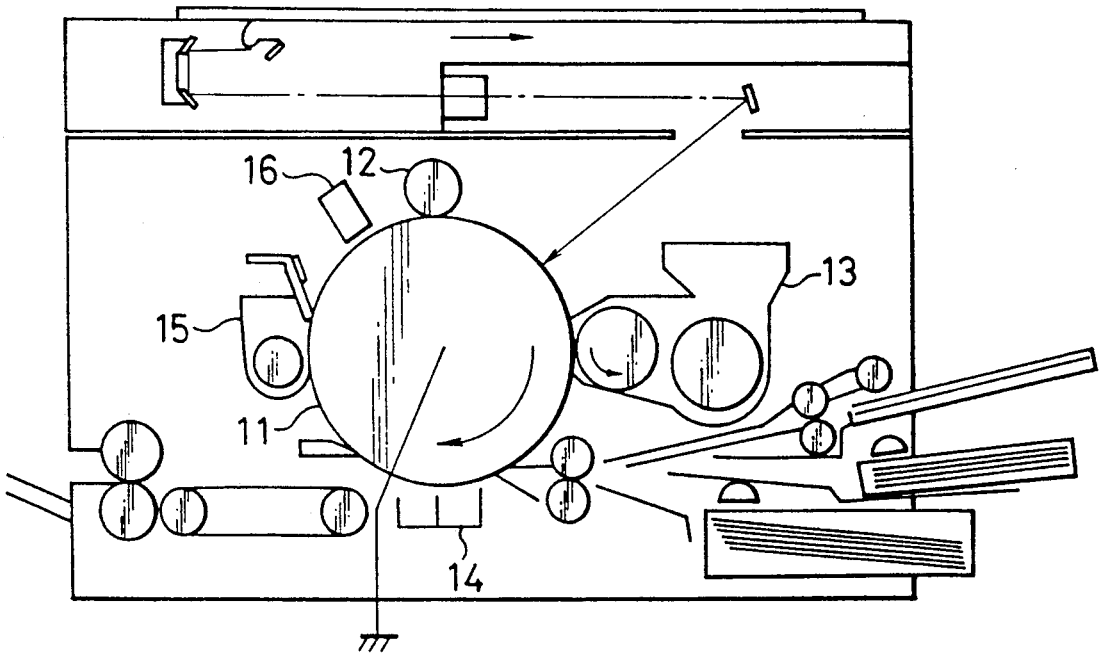
FIG. 1 is a side elevational depiction of a copy machine body according to an embodiment of an image forming apparatus comprising a photoconductor life judging means of the present invention.
Figure 2:
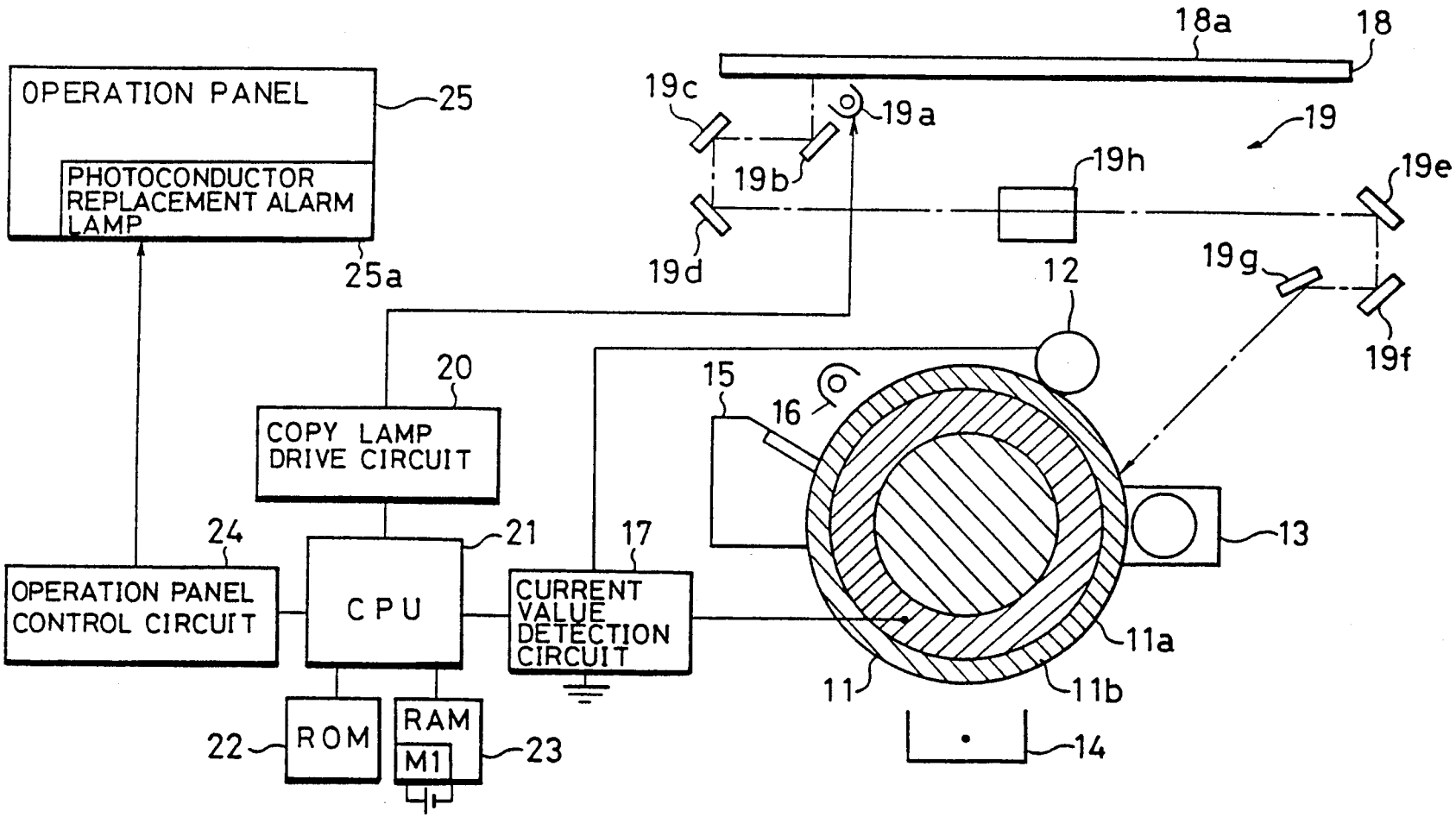
FIG. 2 is a block diagram of essential parts in an embodiment of the image forming apparatus in FIG. 1, showing a arranged state of the photoconductor life judging means of the present invention.

FIG. 1 shows a construction of a copy machine body, an embodiment of an image forming apparatus comprising a photoconductor life judging means according to the present invention. FIG. 2 is an essential block diagram showing a composition of essential parts of an embodiment of the image forming apparatus in FIG. 1 showing the arranged state of the photoconductor life judging means of the present invention.

With reference to FIGS. 1 and 2, the copy machine as an embodiment of the image forming apparatus comprising the photoconductor life judging means of the present invention.

At the central portion in the copy machine body, a drum-type photoconductor 11 having a cylindrical drum base 11*a* and a photoconductive layer 11*b* is rotatably mounted in the direction shown by the arrow in the drawing. A charging roller 12, a developer 13, a transcribing/exfoliating means 14, a cleaner 15, and a discharging lamp 16 are all disposed around the photoconductor 11 as shown FIG. 2. The charging roller 12 is disposed in contact with the photoconductor 11 for charging, and the current value detecting circuit detects the value of the current flowing into the photoconductor 11 upon exposure of the surface of the photoconductor 11.

The document 18*a* to be copied is disposed on a document plate 18 made of a transparent glass material. An optical system device 19 composed of a copy lamp 19*a*, mirrors 19*b* to 19*g* and a lens 19*h* is disposed under the document plate 18.

The first mirror unit composed of the copy lamp 19*a*, the mirror 19*b* and the second mirror unit composed of the mirror 19*c*, 19*d* move along the document plate 18 beneath the document plate 18 to scan the document 18*a* mounted on the document plate 18.

The light reflected by the document 18*a* is then led to the photoconductor 11, on which a discharging process is performed through the mirrors 19*b* to 19*g* and through the lens 19*h* so as to form an electrostatic latent image on the photoconductor 11.

The higher the exposure level of the copy lamp 19*a*, the larger the light amount level of the document reflected light as a whole, so as to cancel more charges on the photoconductor 11. In consequence, the resulting image would become brighter as a whole.

Provided on the upper surface of the copy machine body is an operation panel 25 enclosing a photoconductor replacement alarm lamp 25*a*.

An operation panel controlling circuit 24 indicates the necessity to replace the photoconductor 11 to the user in response to an alarm command output from a central processing unit (CPU) 21.

The CPU preferably includes a read-only memory for storing the program and a random-access memory for storing data in accordance with the program stored in the read-only memory.

The data is regarding to the exposure level of the copy lamp which corresponds to the value of electrical current flowing detected by the current value detection circuit.

Preferably, the central processing unit is adapted to receive the value of electrical current as output from the current value detection circuit, is adapted to read out the exposure level corresponding to the electrical current value from a data table stored in the random-access memory, and is adapted to output the exposure level to the copy lamp.

More preferably, the random-access memory is adapted to store the electrical current value at a time when a life time of the photoconductor is reached.

The photoconductor 11 is grounded through a current detection circuit so that a circuit is formed between the charging roller 12 and the photoconductor 11. Consequently, any rise in the surface potential of the photoconductor due to deterioration of the same raises the value of the electrical current flowing through the charging roller 12. In the illustrated embodiment, the life expectancy of the photoconductor is evaluated by measuring the current value in the charging roller.

Figure 3:
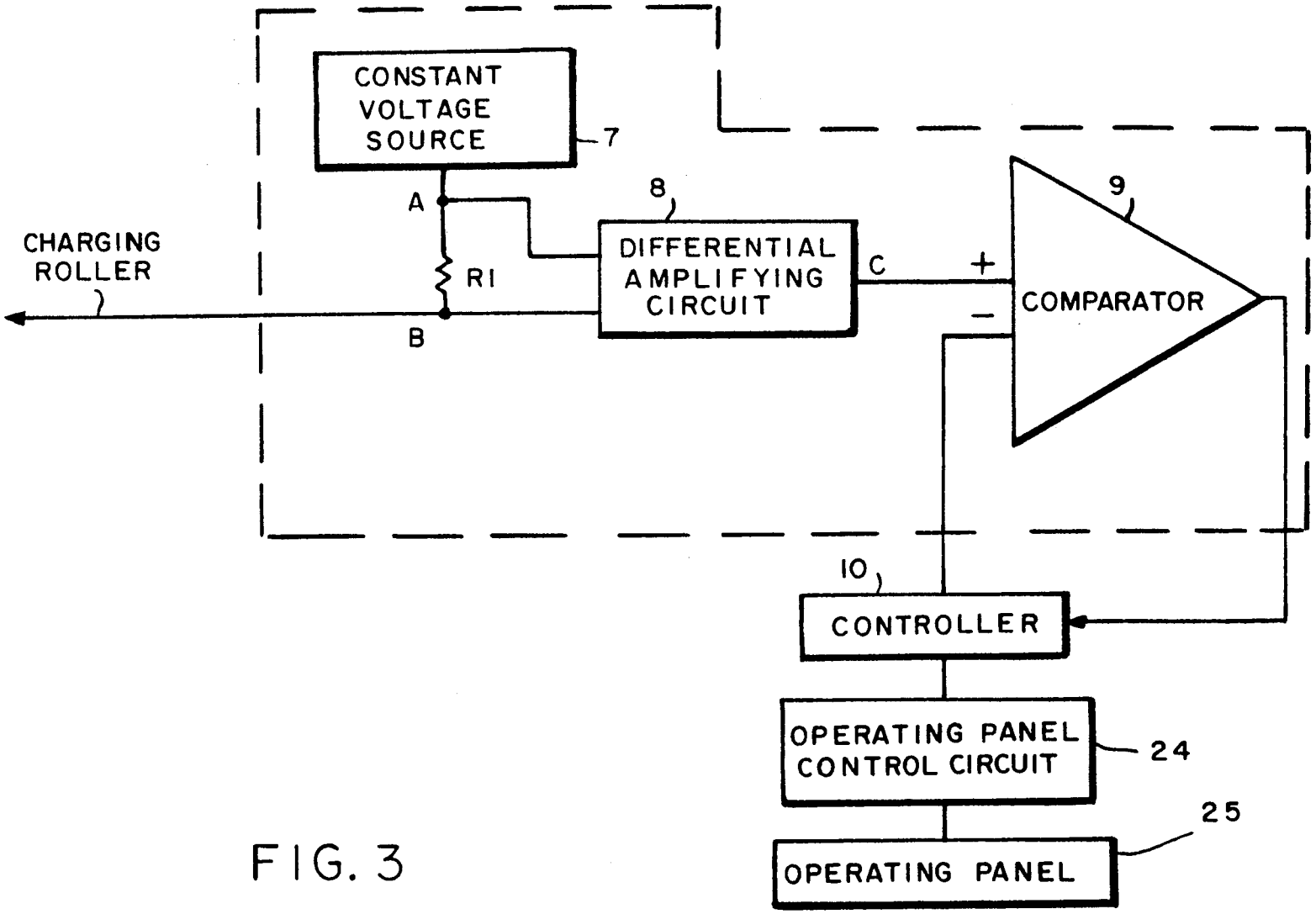
FIG. 3 is a block diagram showing a photoconductor life judging circuit according to the present invention.

A description will now be given of the photoconductor life judging means, with specific reference to FIG. 3 which is a block diagram of the photoconductor life judging circuit.

The composition of the photoconductor life judging circuit is composed will now be described. A constant-voltage source 7 is coupled to the charging roller through a resistor RI, both ends of the resistor RI are coupled to a differential amplifying circuit 8, the output side of a comparator 9 is coupled to a controller 10, the output side of the controller 10 is coupled to the inverted-input side of the comparator 9, and the controller 10 is coupled to an operation panel 25 through an operation panel controlling circuit 24.

When the surface potential of the photoconductor increases over a predetermined value, a fog would arise in the formed image. A reference voltage corresponding to the difference between the photoconductor surface potential proportional to the value of the current flowing into the charging roller 12 when a fog arises in the formed image and the constant-voltage source potential is previously stored in the controller 10. When a charging current flows through the resistor R1, a potential difference would arise between A and B in FIG. 3 since the constant-voltage source 7 is coupled to the charging roller 12 through the resistor R1. The potential difference increases proportionally to the magnitude of the charged current. The potential difference between A and B is amplified by the differential amplifying circuit 8, the output value C of which is then compared to the reference voltage by the comparator 9. When the voltage value at the C point exceeds the reference voltage due to the increase of the charged current, as a result of the comparison aforementioned, the output from the comparator is inverted to provide a judgment as reaching the life limit of the photoconductor. This judged signal is input to the controller 10 which then controls the operating section of the copy machine to indicate the necessity of the photoconductor replacement based on the judged signal. The value of the resistor R1 is, compared to the resistance of the charging roller 12, so small as to be ignored.

If the voltage to be applied to the positive (+) terminal (this voltage value increases as the residual life of the photoconductor is shortened) is smaller than the reference voltage applied to the negative (−) terminal, the comparator 9 outputs a logic e.g. "0" (the output saturates to minus X volts), while in vice versa, if it is larger than that, the comparator 9 outputs a logic "1" (the output saturates to plus X volt).

The reference voltage is, therefore, set to the voltage value at the end of the life of the photoconductor (this value is to be obtained through experiments because of varying on the material of the photoconductor). And the output state (1 or 0) of the comparator 9 is checked by the controller 10 to make judgment on the life of the photoconductor (if the output changes to 1 from 0, this means that the life of the photoconductor life has expired, i.e. it must be replaced).

Figure 4:
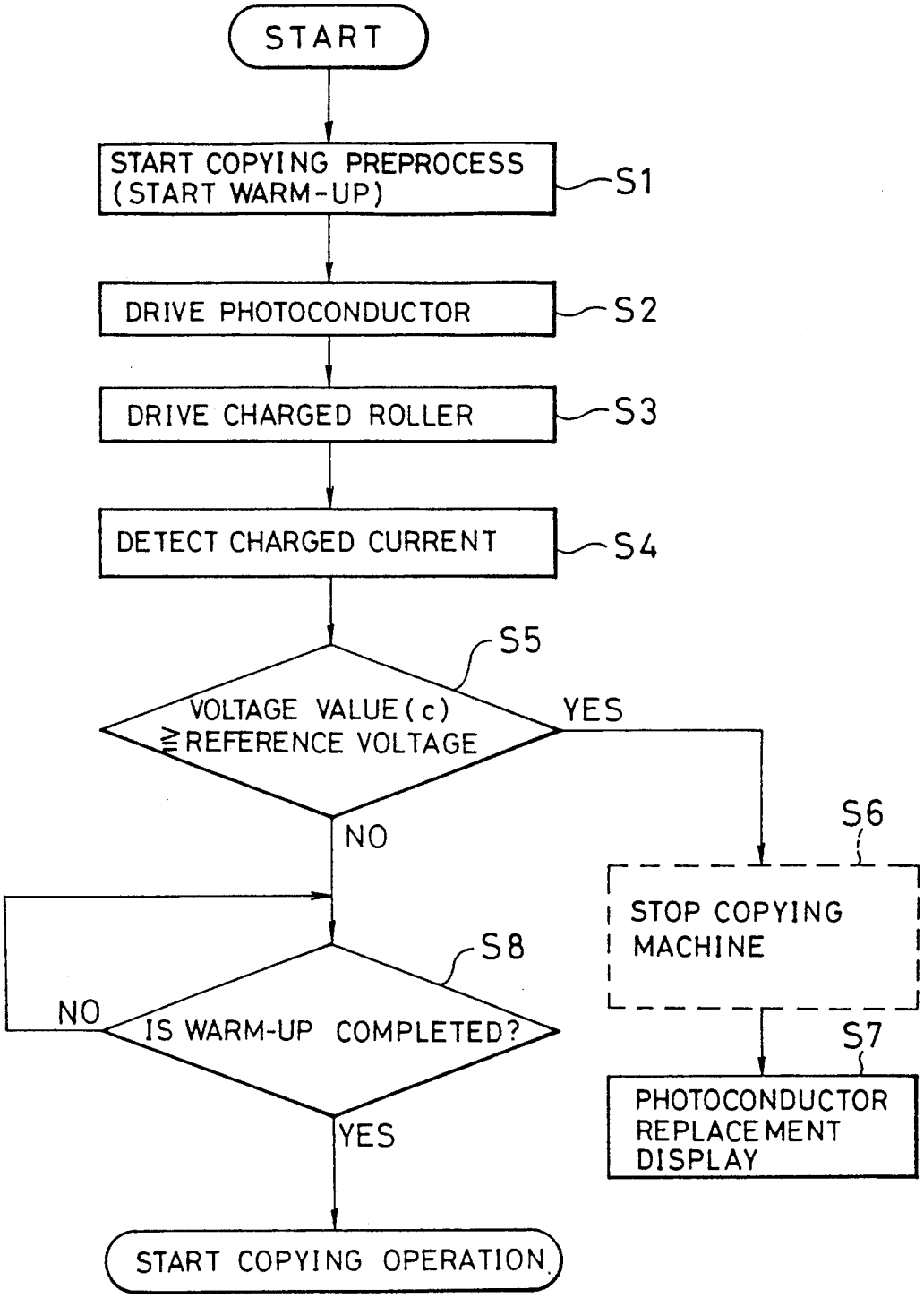
FIG. 4 is a flow diagram for the explanation of the operation of the photoconductor life judging means in FIG. 2.
Figure 5:
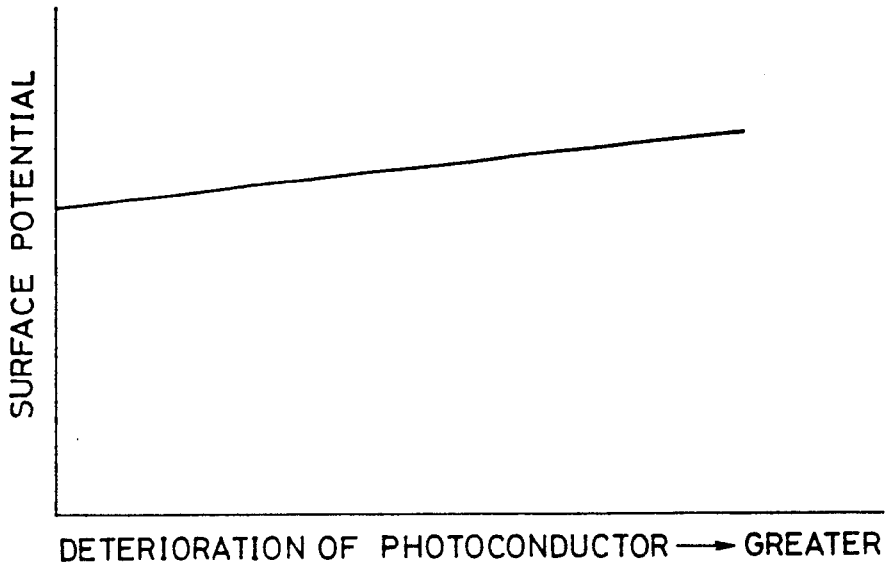
FIG. 5 is a graph showing the relationship between the degree of deterioration of the photoconductor and the surface potential.
Figure 6:
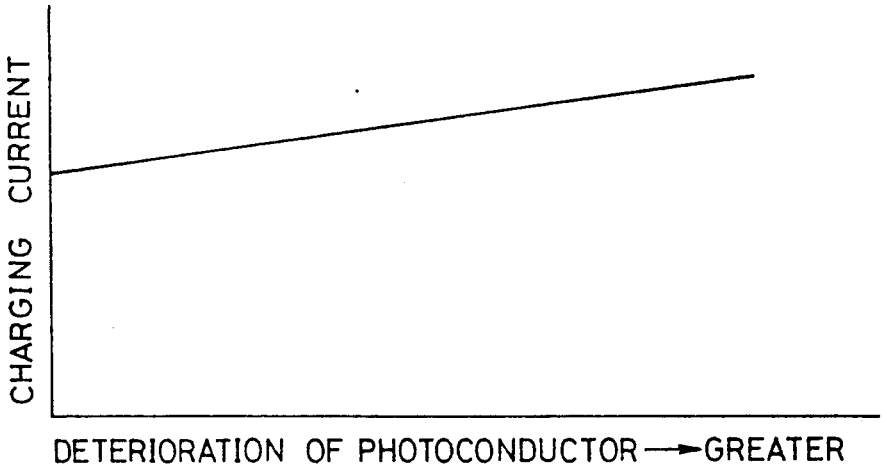
FIG. 6 is a graphic diagram showing the relationship between the degree of deterioration of the photoconductor and the value of the current flowing through the charging roller.

The operation of the copy machine aforementioned will now be described with reference to FIG. 4.

Firstly as a preparative process the copy machine is started to warm up (step S1), and then the photoconductor 11 is driven (step S2), the charging roller 12 is driven (step S3), the current value flowing through the charging roller 12 is sequentially detected as the image forming process advances (step S4), the output voltage value of the operational amplifying circuit 8 (at the point C in FIG. 3) is compared to the reference voltage value having been previously stored in the controller 10 to determined if the former is equal to or larger than the latter (step S5), if the result is "YES" the copying operation is stopped (step S6), and the photoconductor replacement warning lamp on the operation panel is lit to indicate the necessity of replacing the photoconductor 11 (step S7).

On the other hand, if the result in step S5 is "NO", it is determined if the photoconductor and other components have warmed up enough to correctly drive the copy machine (step S8), if the result is "YES" the copying operation starts while if it is "NO" the step S8 will be repeated until the result becomes "YES".

In aforementioned step 6, it is not necessary to stop the copying operation.

Next, the operation of the copy machine with reference to practical measured values will be described.

When assumed that the voltage at A point is 1.3 KV, the resistor R1 is of 10KΩ, the output voltage at the point C in normal state before expiration of the life of the photoconductor is 5 V, and the reference voltage is 7 V, the output voltage at the point C will increase from 5 V to 6 V, . . . as the life of the photoconductor closes to the expiration, during which the output logic of the comparator 9 is "0". When the reference voltage exceeds 7 V even slightly, the output logic of the comparator 9 will change from "0" to "1", and the controller 10 detects this change to perform the indication of photoconductor replacement alarm.

According to the present invention, since the charged state of the photoconductor is directly detected through the value of the current flowing through the charging roller for charging the photoconductor, the life of the individual photoconductor can be exactly judged. Therefore, such disadvantage or waste, as replacing a still usable photoconductor which has taken place in the conventional counting-type photoconductor life judging method, would not arise. In the photoconductor life judging circuit according to this invention, the current flowing through the photoconductor can be accurately measured since V/I is converted by inserting a resistor between the charging roller and the driving power source. Further, since the detector for detecting the value of the current flowing through the charged roller and the judging means are composed of simply-constructed and inexpensive elements including resistor, comparator etc., the productive cost would be lowered so as to avoid waste of providing an expensive detector for a photoconductor which is replaced at each small numbers of copied paper, e.g. only 40,000.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus comprising:

a charging roller disposed in contact with a photoconductor having a photoconductive layer for charging the surface of the photoconductor; and a photoconductor life judging means for judging the photoconductor life, wherein said photoconductor life judging means includes a means for detecting the change of the value of the current flowing through the charging roller and a means for judging the photoconductor life on the basis of the change of the current value.

2. An apparatus according to claim 1, wherein said photoconductor life judging means comprises a photoconductor life judging circuit including a constant voltage source coupled to the charged roller through a resistor RI, a differential amplifying circuit for amplifying the potential difference between both ends of the resistor RI, a comparator for comparing the output voltage from the differential amplifying circuit to a reference voltage, a controller, and a operation panel controlling circuit.

3. An apparatus according to claim 2, wherein said comparator is formed in a central processing unit, and said judging means also is formed in said central processing unit.

4. An apparatus according to claim 3, wherein said central processing unit includes a read-only memory for storing said program and a random-access memory for storing data in accordance with said program stored in said read-only memory.

5. An apparatus according to claim 1, wherein said apparatus further comprises an optical device including a first mirror unit and a second mirror unit, thereby discharging said photoconductor in order to form a latent image of a document on said photoconductor.

6. An apparatus according to claim 5, wherein said first mirror unit includes a copy lamp for radiating said document and a mirror for leading a light reflected from a surface of said document radiating by said copy lamp.

7. An apparatus according to claim 5, wherein said second mirror unit includes a pair of mirrors, each of said pair of mirrors being enabled to move in parallel to and/or in vertical to a document plate so that said document placed on said document plate is scanned.

8. An apparatus according to claim 1, wherein said means for detecting the change of the value of the current flowing through the charging roller detects the value of the current flowing through the charging roller which is proportional to the charged potential at the surface of the photoconductor.

9. An apparatus according to claim 1, wherein said apparatus further comprises an alarm for indicating a replacement of said photoconductor in accordance with a result of said judging means.

* * * * *